US006659563B2

(12) United States Patent
Float et al.

(10) Patent No.: US 6,659,563 B2
(45) Date of Patent: Dec. 9, 2003

(54) ADJUSTABLE QUICK RELEASE FRAMELESS BACK SUPPORT FOR A WHEELCHAIR

(75) Inventors: Jamison Float, Westerville, OH (US); Judy Rowley, Kitchener (CA); Carl Santora, Brunswick, OH (US); Harry Huhndorff, Bay Village, OH (US)

(73) Assignee: Invacare Corporation, Elyra, OH (US)

( * ) Notice: Subject to any disclaimer, the term of this patent is extended or adjusted under 35 U.S.C. 154(b) by 0 days.

(21) Appl. No.: 10/274,398

(22) Filed: Oct. 18, 2002

(65) Prior Publication Data

US 2003/0102706 A1 Jun. 5, 2003

Related U.S. Application Data

(60) Provisional application No. 60/330,261, filed on Oct. 18, 2001.

(51) Int. Cl.[7] ..... A47C 7/36

(52) U.S. Cl. ..... 297/440.2; 297/354.1; 297/354.12; 297/440.21

(58) Field of Search ..... 297/353, 354.1, 297/354.12, 440.2, 440.21

(56) References Cited

U.S. PATENT DOCUMENTS 556,168 A * 3/1896 Taylor ..... 280/209
5,062,677 A * 11/1991 Jay et al. ..... 297/440.2
5,127,709 A * 7/1992 Rubinstein et al. ..... 297/440.2
5,364,162 A * 11/1994 Bar et al. ..... 297/284.8
5,407,248 A * 4/1995 Jay et al. ..... 297/284.1
5,944,385 A * 8/1999 Pearce ..... 297/354.12
5,947,562 A * 9/1999 Christofferson et al. ..... 297/440.22
6,095,611 A * 8/2000 Bar et al. ..... 297/440.21
6,257,664 B1 * 7/2001 Chew et al. ..... 297/284.9
6,460,933 B1 * 10/2002 Bors et al. ..... 297/440.2
6,474,743 B1 * 11/2002 Harker et al. ..... 297/440.21

* cited by examiner

*Primary Examiner*—Peter R. Brown
*Assistant Examiner*—Joseph Edell
(74) *Attorney, Agent, or Firm*—Laura F. Shunk; Hudak, Shunk & Farine Co. LPA

(57) ABSTRACT

The invention provides a back support assembly mounted to the upright posts or canes of a wheelchair. The back support assembly can be adjusted independently with respect to a number of modes of adjustment including seat depth and width, the back height above the seat, and the angle of incline with respect to a plane defined by the wheel chair canes to which the back support is mounted. The back support assembly has a back support that is mounted at four points to cane clamps on each of the canes. A quick release mechanism is provided by a locking pawl on a mounting arm which permits single-handed release and removal of the back support from the mounting hardware while retaining the desired adjustment when the back support is remounted on the wheelchair. The back support assembly is frameless, and eliminates the additional weight that a support frame or carriage would add.

12 Claims, 2 Drawing Sheets

ADJUSTABLE QUICK RELEASE FRAMELESS BACK SUPPORT FOR A WHEELCHAIR

This patent application is based upon U.S. Provisional Application Ser. No., 60/330,261, Filed Oct. 18, 2001.

The invention relates generally to back supports for use on wheelchairs, and more particularly to a back support which is adjustable independently with respect to seat depth, seat width, the back height above the seat, and the angle of incline with respect to a plane defined by the wheel chair canes to which the back support is mounted. This back support has a convenient release mechanism that permits the back support assembly to be removed from the mounting hardware so that the wheelchair can be folded for transport, or storage. The back is easily remounted on the mounting hardware without having to reset the various modes of adjustment.

BACKGROUND OF THE INVENTION

Increasing focus has been paid to the seating needs of wheelchair users. Seating should be provided which can accommodate a variety of health issues and reasons for wheelchair use. In the past, adjustability has often been accomplished using custom seating which is designed to meet the needs of an individual user. However, custom seating is expensive and often inefficient with respect to the issue of inventory.

Moreover, even for standard seating which provides for some levels of adjustment, the user generally relies on a technician to set the position of the back support. While it is desirable to be able to remove a back support in order to store, or transport a wheelchair, it is highly preferable to provide for removal which retains the set adjustments. In addition, it is desirable to facilitate easy release and transport of the back support.

The current invention provides a back support for a wheelchair which can be adjusted independently with respect to a number of modes of adjustment; notably, adjustments can be made to seat depth, seat width, the back height above the seat, and the angle of incline with respect to a plane defined by the wheel chair canes to which the back support is mounted. A quick release mechanism is provided that permits single-handed release and removal while retaining the desired adjustment when the back support is remounted on the wheelchair. The back support assembly is frameless, and eliminates the additional weight that a support frame or carriage would add.

SUMMARY OF THE INVENTION

The back support assembly of the present invention comprises a back support encompassing two upholstered rigid back shells, one which is a lumbar support member, and one which is a thoracic support member. These two support members are joined either by a rigid connection or by a resilient hinge member. The back support is mounted by a series of L-shaped brackets which are linked to a mounting arm directly to mounting hardware on the canes of a wheelchair. The mounting arm is releasably suspended from two adjustable mounting posts of a cane bracket that forms a part of the mounting hardware which comprises a pair of cane mounting clamps. In particular, the lower of these mounting posts can be variably positioned in order to change the angle of incline of the back support. The mounting arms each have a pair of open C-shaped mounting recesses that are captured on the mounting posts by sliding the mounting arm backward along the post until the back support drops down into the top of the C to the mounted position. A spring biases locking pawl pivots to a closed position to lock the mounting arm on the upper mounting post. The pawl is triggered to an open position by a unitary mechanism that engages both of the two pawls at the same time. Preferably, the trigger mechanism can be a strap or cable that can extend upward to allow the user to hold the trigger and to engage a handle in the back support with the same hand. The four L-shaped brackets include longitudinal slots in the long arm for attachment to the rear of the back support members to provide for width adjustment so as to accommodate a variety of chair widths. The cane bracket has a dovetail connection to the cane clamp in order to be able to change the depth of the seat, by changing the location of the mounting posts of the cane bracket relative to the canes.

DETAILED DESCRIPTION OF THE INVENTION

Figure 1:
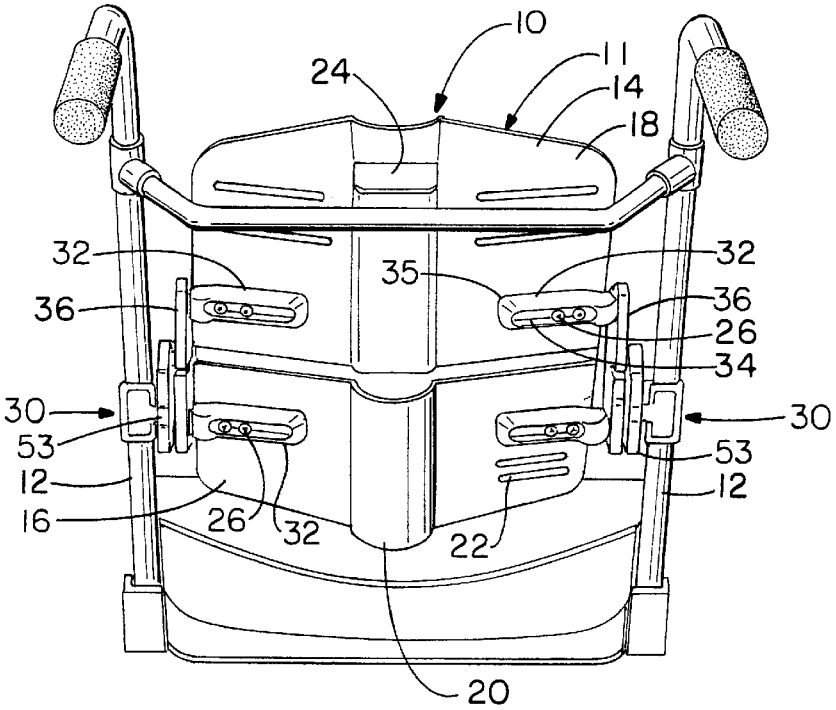
FIG. 1 is a back view of the back support assembly in accordance with the present invention.
Figure 2:
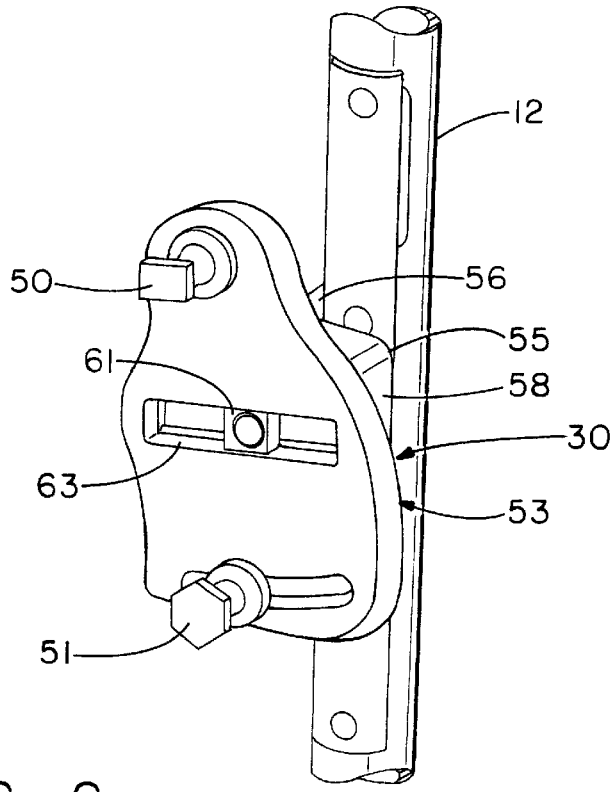
FIG. 2 is an inboard view of the cane clamp shown in FIG. 1.
Figure 4:
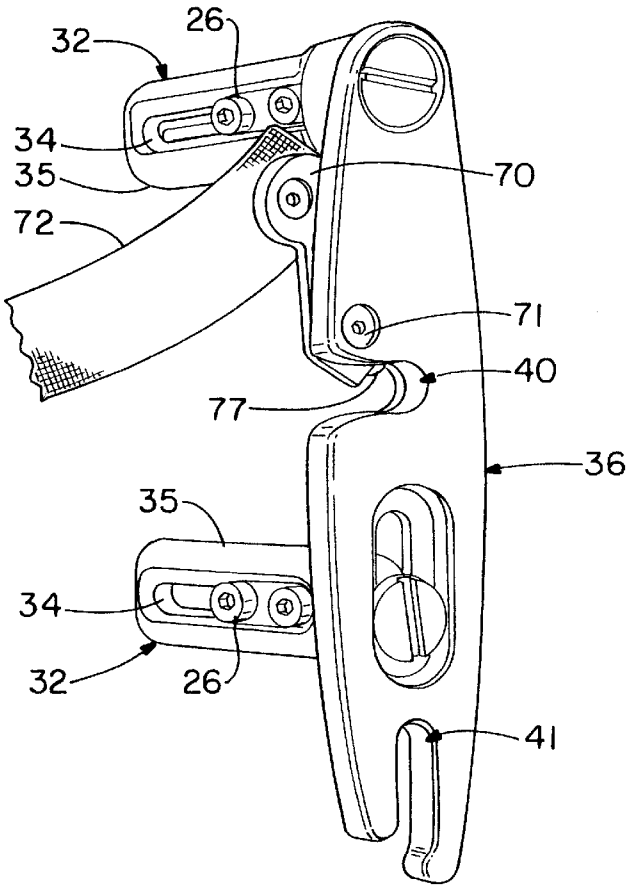
FIG. 4 is a detailed view of the mounting arm and the locking pawl shown in FIG. 1.
Figure 3:
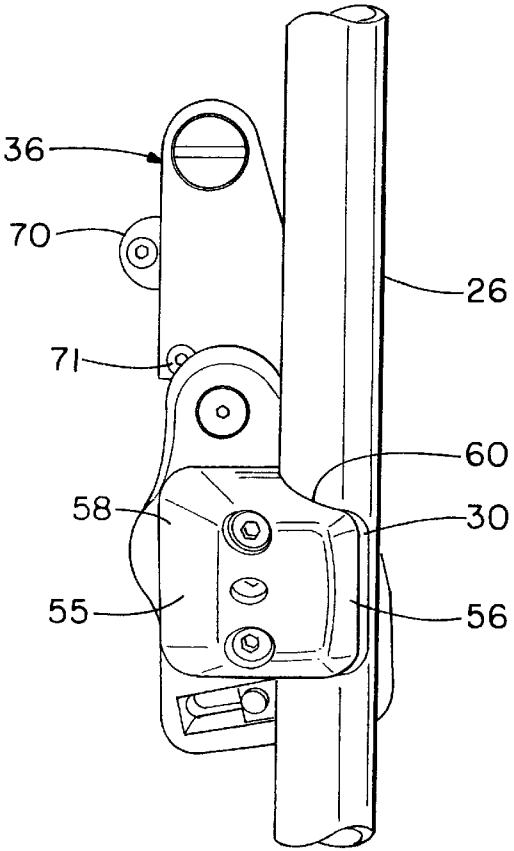
FIG. 3 is an outboard view of the can clamp shown in FIG. 1.

The back support assembly of the present invention is shown generally at 10 in FIG. 1. The back support assembly is mounted between two generally upright vertical posts 12 commonly known as "canes" of a wheelchair. The present invention is particularly advantageous for a foldable wheelchair, such as the one shown which utilizes a pair of pivoting cane connections to rotate the canes forward and downward to fold the chair.

The back support assembly 10 includes a back support 11 comprising a pair of back support members which comprise rigid back shells 14. In particular, these consist of a lower lumbar support 16 and an upper thoracic support 18. The supports have padded upholstery on the front side, and a cover. These are not shown so that the width adjustment mechanism can be seen. The rigid shells have a rear recess 20 to accommodate further cushioning for the user's spine. The shells further have a gentle contour inward about the axis defined by the spine. Adjustment slots 22 can permit an adjustable means of mounting optional lateral supports. The thoracic support shell also includes a cutout handhold 24 for ease of removal after release from the cane clamp assembly 30. The shells 14 are each attached such as by screws 26 to a pair of L-shaped width brackets 32 which extend outwardly in the lateral direction from either side of each support 14. The brackets 32 include a slot 34 in the long arm portion 35 of the bracket, which allows the sliding adjustment of the width between of a pair of mounting arms 36. The top and bottom of each mounting arm 36 is secured to pair of short arm sections 38 of the L-shaped brackets 32 on each side. Each of the two mounting arms 36 includes a pair of open C-shaped recesses 40, 41. The top recess opens to the back while the bottom recess opens to the bottom. The recesses include an open necked area which leads to an upward hook that can be mounted to the upper and lower mounting posts 50, 51 which extend inwardly from a cane bracket 53 for each side. The upper mounting post forms a pivot point and the lower mounting post can be variably positioned in a slot in the cane bracket to define the angle of incline of the back support. The cane bracket 53 forms a part of the pair of cane clamp assemblies 30 which are mounted to the pair of canes on either side of the wheelchair.

The cane clamp assemblies further include a cane collar 55 that has an inner and an outer portion 58, 56 respectively. The cane bracket 53 has a dovetail connection 60 formed by a dovetail member 61 in the cane collar 55 received in a slot 63 in the cane bracket 53. The relative position of the cane bracket to the cane collar is set such as by a lock screw. It should be understood that the dovetailing portions could be reversed. This sliding relation allows for an adjustable position between the mounting arm and the cane clamp. Further, the inner portion 58 of the cane collar 55 has front and back parallel cylindrical grooves 60 which can be used to mount the collar extending forward of the cane or rearward of the cane in order to increase the amount of longitudinal displacement of the cane brackets relative to the canes. One of the grooves is sized to accommodate a ⅞ inch diameter cane, while the other is sized to accommodate a one inch diameter cane. The relative position, front and back, of these grooves can be changed by rotating the outer portion 180 degrees relative to the inner portion. The outer portion 56 includes a groove which completes the cane recess to secure the collar to its cane. It further includes a parallel hemi-cylindrical rounded area 59 that fits into the unused groove of the outer section. This rounded area has a complex cross section that causes the cane collar to clamp onto the cane. The two portions include a central boss and dimple that permits the portions to be flipped relative to each other.

The angle of incline is adjusted by changing the relative position of the lower mounting post 51 as it projects through the cane bracket 53. The upper post defines the axis of tilt for the mounting arm. However, in particular for the back support assembly having a locking resilient hinge connection, the relative angle of the two support shells can be changed. The resilient hinge connection can be provided by a flat elastomeric bushing between the each of the two portions which together make the hinge, and the rear surface of the back shell. Thus, the lumbar support could be inclined to help compensate for a reverse pelvic tilt.

The mounting arms 36 each includes a inward locking pawl 70 that can be pivoted about pivot pin 71 into an unlocked position by pulling on a release strap 72 that is attached to a tab on each of the locking pawls so as to operate them by rotating them upward. The pawls include a coil spring mounted in an internal recess that biases the pawl circumferentially into the locked position where its recess 77 engages the upper mounting post. This causes the pawl to close the upper open mounting recess on the mounting arm and lock the back support on the mounting hardware. Thus, while the back support has the advantage of a robust four point mounting position on the mounting posts relative to the pair of canes, the release mechanism can be triggered by a single activation mechanism, i.e. by a single release strap which rotate both of the locking pawls upward into an open position so that the back support assembly can be lifted upward off of the cane clamp assembly, advantageously by the same hand which engages the trigger and the handle in the back support. Again other unitary trigger mechanisms could be used to unlock the mounting arms for removal from the cane clamp assemblies.

What is claimed is:

1. A back support assembly for a wheelchair having a spaced pair of canes, said back support assembly comprising:

a pair of cane clamps wherein each cane clamp has a cane bracket and a cane collar;

a back support which has a right side and a left side each independently attached to an upper adjusting bracket and a lower adjusting bracket together joined to a mounting arm having a spaced pair of C-shaped recesses that each receive one of a pair of mounting posts projecting inwardly from the cane brackets;

said mounting arm further includes a releasable lock which secures the mounting arm on the mounting posts;

and wherein the position of the mounting posts relative to a plane defined by the pair of canes can be varied.

2. A back support assembly as set forth in claim 1 wherein the back support comprises upper and lower rigid back shells each of which include upholstery.

3. A back support as set forth in claim 2 wherein a back shell includes a cut out hand hold.

4. A back support assembly as set forth in claim 2 wherein the upper and lower rigid back shells are joined to each other by a hinged connection.

5. A back support assembly as set forth in claim 4 wherein the hinged connection is a locking connection so that the relative angle of the shell can be locked at a desired angle.

6. A back support as assembly set forth in claim 4 wherein the hinged connection is a resilient hinged connection so that the shells are able to flex relative to each other.

7. A back support assembly as set forth in claim 1 wherein the position of the cane brackets can be varied with respect to the plane defined by the pair of canes to define the seat depth.

8. A back support assembly as set forth in claim 7 wherein the cane bracket is joined to the cane collar by a sliding connection.

9. A back support assembly as set forth in claim 8 wherein the sliding connection is a dovetail connection.

10. A back support assembly as set forth in claim 1 wherein the position of the one of the two mounting posts can be varied in the cane bracket so as to change the angle of incline of the back support.

11. A back support assembly as set forth in claim 1 wherein each mounting arm includes a locking pawl which secures one of said mounting posts in a mounting recess.

12. A back support assembly as set forth in claim 11 where a unitary trigger simultaneously engages both of the locking pawls to enable the back support to be removed from the cane clamps.

* * * * *